US005927490A

United States Patent [19]

Suk

[11] Patent Number: 5,927,490

[45] Date of Patent: Jul. 27, 1999

[54] CLUB-SEPARATING GOLF BAG COLLAR

[76] Inventor: Young J. Suk, 34 Garvies Point Rd., Glen Cove, N.Y. 11542

[21] Appl. No.: 08/668,348

[22] Filed: Jun. 26, 1996

[51] Int. Cl.[6] ..... A63B 55/00

[52] U.S. Cl. ..... 206/315.6; 206/315.3

[58] Field of Search ..... 206/315.6, 315.3, 206/315.2; 211/70.2

[56] References Cited

U.S. PATENT DOCUMENTS

| | | | |
|---|---|---|---|
| 3,101,108 | 8/1963 | Ingoldt | 206/315.6 X |
| 3,164,185 | 1/1965 | Ingoldt | 206/315.6 X |
| 4,241,774 | 12/1980 | Pell | 206/315.6 |
| 4,944,396 | 7/1990 | Larkin | 206/315.6 |
| 4,995,510 | 2/1991 | Fletcher | 206/315.6 |
| 5,135,107 | 8/1992 | Ingraham | 206/315.6 |
| 5,518,113 | 5/1996 | Boone | 206/315.6 |

*Primary Examiner*—Allan N. Shoap
*Assistant Examiner*—Christopher J. McDonald

[57] ABSTRACT

An improved golf bag top opening collar using not only the known technique of obviating golf club contact with each other by physical separation of the golf iron openings, but also by promoting shifting movement of the irons to out-of-contact positions using appropriately directionally configurated bottom curved surfaces bounding the golf iron openings.

1 Claim, 2 Drawing Sheets

CLUB-SEPARATING GOLF BAG COLLAR

The present invention relates generally to improvements in a club-separating golf bag collar, the improvements more particularly not only obviating club head contact in the golf bag standing erect position but also in the golf bag angular orientation or carrying position.

EXAMPLE OF THE PRIOR ART

Incorporated herein in its entirety by this reference, is one of many patents addressing the problem of keeping golf clubs, or more accurately the heads thereof, apart from each other to obviate any damage by contact, namely U.S. Pat. No. 4,995,510 for Club-Separating Insert System for Golf Bags issued to Carl C. Fletcher, Jr. on Feb. 26, 1991.

The prior art practice exemplified by the '510 patent employs individual openings in the collar embodied as an insert in the top opening of the golf bag and relies on the sizes of the clearances about and between the openings to obviate contact between the smaller-sized golf iron heads, the shafts of the woods being long enough to hold the woods' club heads above and out-of-contact with the irons. The clearance-surrounded plural golf iron openings require a large diameter golf bag top opening which has obvious drawbacks.

Broadly, it is an object of the present invention to provide an acceptable diameter-sized club-separating golf bag top opening collar overcoming the foregoing and other shortcomings of the prior art.

More particularly, it is an object to use not only physical separation of the individual golf iron openings, but also promoted shifting movement of the golf irons in these openings to obviate golf club contact, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
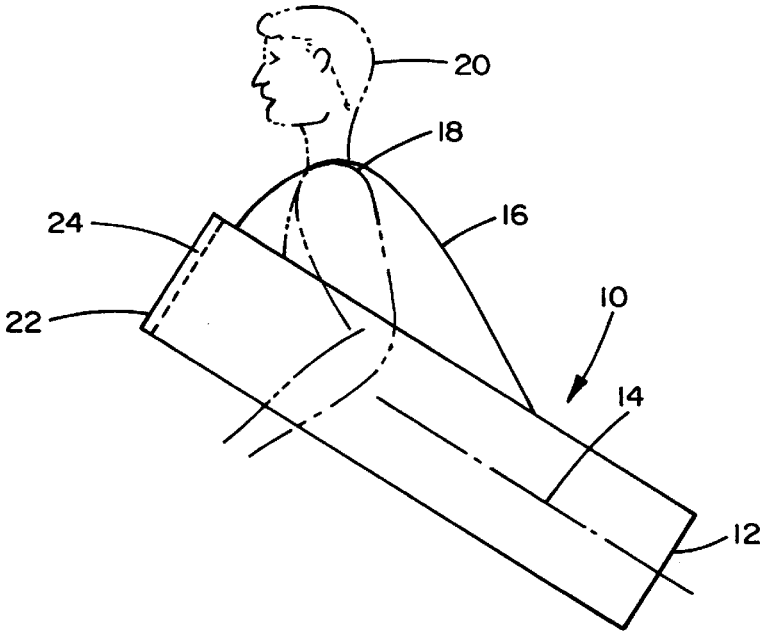
FIG. 1 is a partial side elevational view of a carried golf bag.

The golf bag 10 of FIG. 1, as well-known, when not standing vertical on its bottom 12, is carried in an angular orientation, as noted by reference line 14, suspended by a shoulder strap 16 disposed over a shoulder 18 of the caddy or golfer 20. Appropriately built into the golf bag top opening 22 is a collar 24 of a known type providing golf club separation using plural golf club-receiving individual openings, in the use of which the clearances between the openings is optimumly effective during the standing erect position of the golf bag to keep the golf clubs out of contact with each other. However, heretofore, reliance on the clearances to obviate golf club contact during the carrying of the golf bag in its angular orientation was only nominally effective.

Figure 2:
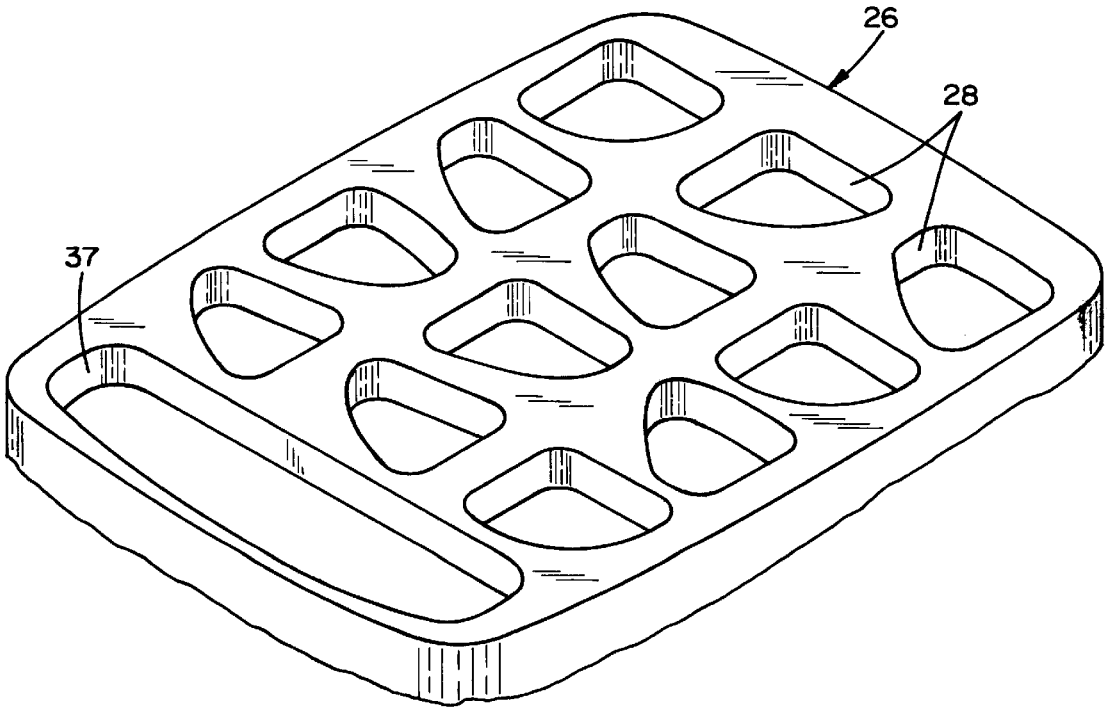
FIG. 2 is an isolated partial perspective view of the within inventive top opening collar of the golf bag.
Figure 3:
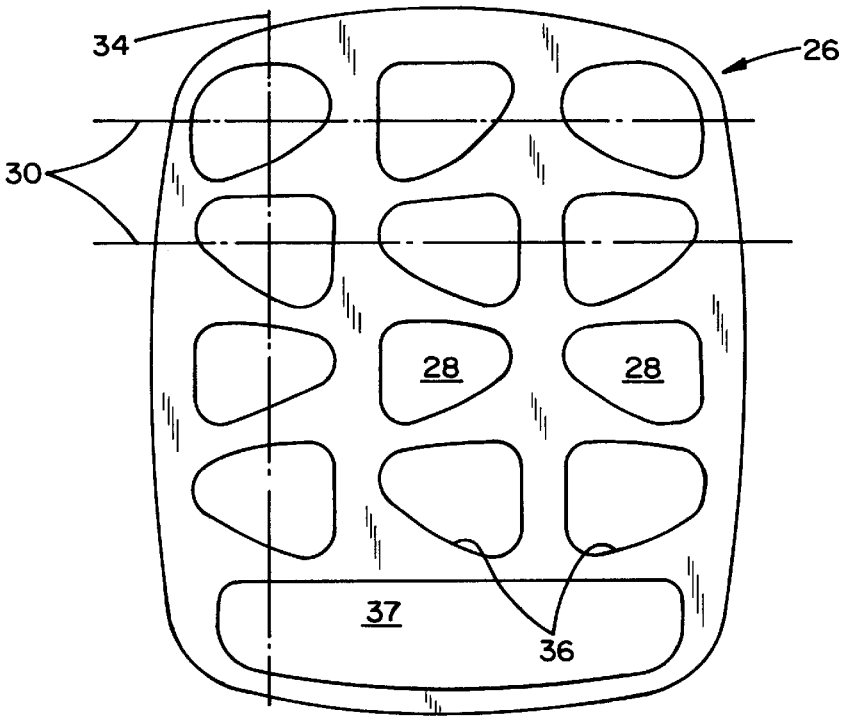
FIG. 3 is a front elevational view of the collar.
Figure 4:
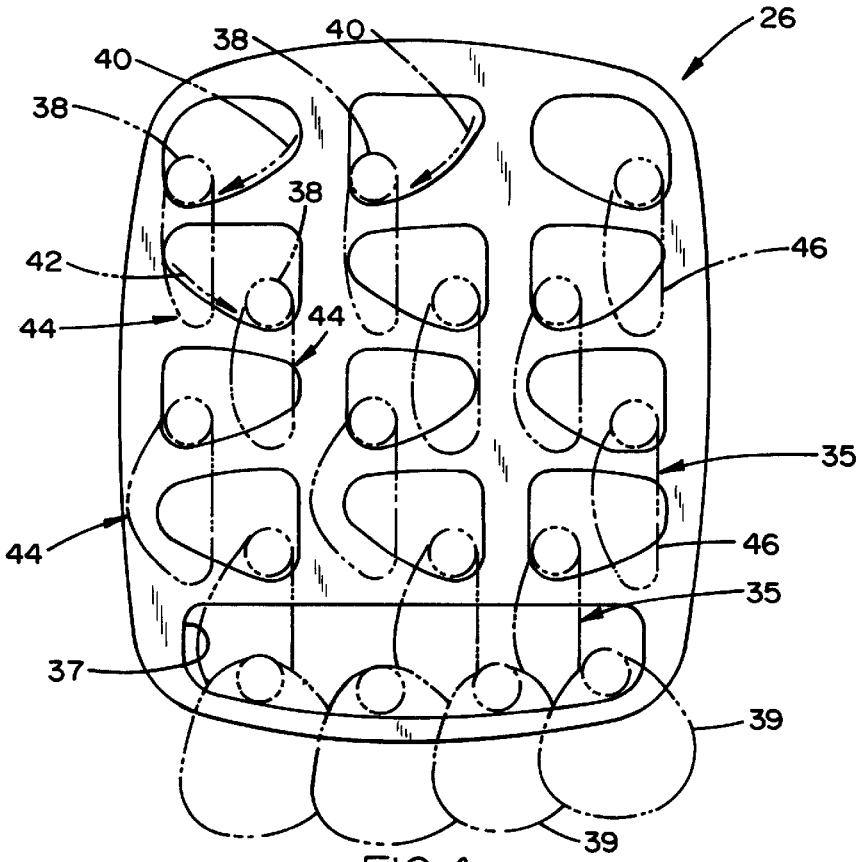
FIG. 4 is a view similar to FIG. 3 illustrating in phantom perspective the heads of the golf clubs.

Golf club separation even during golf bag angular orientation is now achieved to an optimum extent using the within inventive top opening golf bag collar 26 of FIGS. 2–4 in which individual golf-receiving openings, individual and collectively designated 28, are positioned in an array of horizontally oriented rows, as exemplified by the rows 30 (FIG. 3) which also correspondingly orients the openings 28 in vertical alignment with each other, as noted at 34, so that twelve openings for the "irons" 35 and a large opening 37 for the "woods" 39 fits within the confines of the collar 26 sized to fit the size and shape of the golf bag 10. The vertical alignment 34 however, as already noted, heretofore contributed to golf club contact during angular orientation of the golf bag.

This is now obviated using the collar 26 of FIGS. 2–4 by providing as a bottom to each golf iron opening 28 a curved sliding surface, individually and collectively designation 36, configurated as illustrated, to cause golf club shaft 38 sliding movements therealong in opposite left and right directions 40 and 42 (FIG. 4). Thus, the irons 35 which in vertical alignment would contact each other, by now being moved left and right in adjacent rows 30 and thus into misalignment with each other, demonstrate optimum effectiveness in providing golf club separation by the within inventive collar 26 even in the angular orientation of the golf bag 10, since when at an angle the weight of each golf iron club head 46 contributes to the directional sliding movements 40 and 42.

While the golf bag collar herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A system for obtaining golf club separation using a top opening golf bag collar comprising in said top opening golf bag collar an array of horizontal rows of individual openings in adjacent rows of which said individual openings are in vertical alignment with each other, and a curved sliding surface bounding a bottom of said individual openings causing club-sliding movement therealong in opposite left and right directions in adjacent rows, whereby golf clubs inserted in said individual openings are vertically misaligned to correspondingly obviate contact therebetween during angular orientation of said golf bag.

* * * * *